US007503379B2

(12) United States Patent
Batllo et al.

(10) Patent No.: US 7,503,379 B2
(45) Date of Patent: Mar. 17, 2009

(54) METHOD OF IMPROVING THE REMOVAL OF INVESTMENT CASTING SHELLS

(75) Inventors: Francois Batllo, Burr Ridge, IL (US); David S. Viers, Aurora, IL (US); Jeffrey S. Mosher, Lakewood, OH (US)

(73) Assignee: Nalco Company, Naperville, IL (US)

( * ) Notice: Subject to any disclaimer, the term of this patent is extended or adjusted under 35 U.S.C. 154(b) by 0 days.

(21) Appl. No.: 11/368,561

(22) Filed: Mar. 6, 2006

(65) Prior Publication Data

US 2006/0144550 A1 Jul. 6, 2006

Related U.S. Application Data

(63) Continuation of application No. 10/964,903, filed on Oct. 14, 2004, now abandoned.

(51) Int. Cl.
*B22C 1/02* (2006.01)

(52) U.S. Cl. ..... 164/519

(58) Field of Classification Search ..... 164/518, 164/519, 361

See application file for complete search history.

(56) References Cited

U.S. PATENT DOCUMENTS

| | | | | |
|---|---|---|---|---|
| 4,186,222 | A | 1/1980 | Sellars et al. | |
| 4,316,498 | A * | 2/1982 | Horton | 164/519 |
| 4,432,798 | A | 2/1984 | Helferich et al. | |
| 5,280,819 | A | 1/1994 | Newkirk et al. | 164/98 |
| 5,569,320 | A | 10/1996 | Sasaki et al. | 106/287.26 |
| 5,944,088 | A | 8/1999 | Feagin | |
| 6,257,316 | B1 | 7/2001 | Vandermeer | 164/518 |
| 6,390,179 | B1 | 5/2002 | Yasrebi et al. | |
| 6,746,528 | B1 | 6/2004 | Horton et al. | |
| 6,776,219 | B1 | 8/2004 | Cornie et al. | |
| 2007/0151702 | A1 | 7/2007 | Batllo | 164/516 |

FOREIGN PATENT DOCUMENTS

| | | |
|---|---|---|
| GB | 1410634 | 3/1976 |
| JP | 3-258438 | * 11/1991 |
| JP | 3-258438 A | * 11/1991 |

OTHER PUBLICATIONS

Office Action, U.S. Appl. No. 10/964,903, Sep. 6, 2005.

* cited by examiner

*Primary Examiner*—Kevin P Kerns
(74) *Attorney, Agent, or Firm*—Peter A. DiMattia; Michael B. Martin

(57) ABSTRACT

A method of improving the removal of an investment casting shell surrounding a metallic article. The shell is made from the deposit of layers refractory slurry and stucco onto a pattern. The shell contains, after firing, an amount of an alkali metal oxide or an alkaline earth metal oxide sufficient to reduce the strength of the shell. By this invention, after firing of the shell and pouring of the molten metallic part into the shell, the shell is hydrated to further reduce the strength of the shell, to facilitate its removal from the metallic part.

10 Claims, 1 Drawing Sheet

METHOD OF IMPROVING THE REMOVAL OF INVESTMENT CASTING SHELLS

CROSS REFERENCE TO RELATED APPLICATIONS

This application is a continuation application of U.S. patent application Ser. No. 10/964,903, which was filed on Oct. 14, 2004 now abandoned.

FIELD OF THE INVENTION

This invention relates generally to investment casting and, more particularly, to a method of improving the removal of investment casting shells.

BACKGROUND OF THE INVENTION

Investment casting, which has also been called lost wax, lost pattern and precision casting, is used to produce high quality metal articles that meet relatively close dimensional tolerances. Typically, an investment casting is made by first constructing a thin-walled ceramic mold, known as an investment casting shell, into which a molten metal can be introduced. Shells are usually constructed by first making a facsimile or pattern from a meltable substrate of the metal object to be made by investment casting. Suitable meltable substrates may include, for example, wax, polystyrene, or plastic.

Next, a ceramic shell is formed around the pattern. This may be accomplished by dipping the pattern into a slurry containing a mixture of liquid refractory binders such as colloidal silica or ethyl silicate, plus a refractory powder such as quartz, fused silica, zircon, alumina, or aluminosilicate, and then sieving dry refractory grains onto the freshly dipped pattern.

The steps of dipping the pattern into a refractory slurry to form a layer, and then sieving onto the freshly dipped pattern dry, refractory grains as an added "stucco" layer, may be repeated until the desired thickness of the shell is obtained. However, it is preferable if each coat of slurry and refractory grains is air-dried before subsequent coats are applied.

The shells are built up to a thickness in the range of about ⅛ to about ½ of an inch (from about 0.31 to about 1.27 cm). After the final dipping and sieving, the shell is thoroughly air-dried. The shells made by this procedure have been called "stuccoed" shells because of the texture of the shell's surface.

The shell is then heated to at least the melting point of the meltable substrate. In this step, the pattern is melted away leaving only the shell and any residual meltable substrate. The shell is then heated to a temperature high enough to vaporize any residual meltable substrate from the shell. Usually before the shell has cooled from this high temperature heating, the shell is filled with molten metal. Various methods have been used to introduce molten metal into shells including gravity, pressure, vacuum and centrifugal methods. When the molten metal in the casting mold has solidified and cooled sufficiently, the casting may be removed from the shell.

The complete removal of the cast or shell surrounding the part, which is sometimes called the "knock-out", often requires long, dirty, dangerous, and costly processes, using sandblasting, mechanical vibration, or caustic baths.

Investment casting molds must withstand significant mechanical and drying stresses during their manufacture. Ceramic shells are designed having high green (air dried) strength to prevent damage during the shell building process. Once the desired mold thickness is achieved, it is dewaxed and preheated to approximately 1800° F. At this point, it is removed from the high temperature furnace and immediately filled with liquid (molten) metal. If the mold deforms while the metal is solidifying (or in a plastic state), the casting dimensions will likely be out of specification. To prevent high temperature deformation, molds are designed to have substantial hot strength. Once the casting is solidified and cooled, low fired strength is desired to facilitate the knock out or removal of the ceramic mold from the metal casting.

Most investment casting molds contain significant quantities of silica. The silica usually starts as an amorphous (vitreous) material. Fused silicas and aluminosilicates are the most common mold materials. When exposed to temperatures above approximately 1800° F., amorphous silica devitrifies (crystallizes) forming beta cristobalite. Cristobalite has low (alpha) and high (beta) temperature forms. The beta form has a specific gravity very close to that of amorphous silica so mold dimensions remain constant and stresses associated with the phase transformation are minimal. Upon cooling, beta cristobalite transforms to the alpha form. This phase transformation is accompanied by an approximate 4% volume change that creates numerous cracks in the shell, thereby facilitating mold removal. Cristobalite phase transition reduces the fired strength of silica containing investment casting molds.

Although investment casting has been known and used for thousands of years, the investment casting market continues to grow as the demand for more intricate and complicated parts increase. Because of the great demand for high-quality, precision castings, there continuously remains a need to develop new ways to make investment casting shells more efficiently, more cost-effective and defect-free. For instance, if shell strength was maintained to the point of metal solidification, followed by a reduction in strength as the shell cools, improvements in productivity could be realized through improved knock out (shell removal). This is particularly desirable for non-ferrous alloys, e.g. alloys of aluminum, copper and magnesium, because their melting and pouring temperatures are insufficient to promote cristobalite formation and easy knock out.

The knock out is especially difficult when the part presents a blind hole or a small cavity in which the ceramic is under compression. The compression occurs during the cooling of the metal parts, which in general have a higher coefficient of thermal expansion (CTE) than the ceramic shells. This effect is especially accentuated in non-ferrous castings because of the high coefficient of thermal expansion of this metal ($>18\times 10^{-6}\ m/m$).

Non-ferrous castings produced by investment casters are rather fragile, so they are cleaned by water or sand blasting, compared with the aggressive shot blast and vibratory cleaning for steel and high temperature alloy castings. Residual ceramic on steel castings is dissolved away using concentrated acids and bases or molten salt baths. Chemical incompatibility excludes their use on aluminum and magnesium castings. If a binder was developed having low fired strength and associated easy knock out properties upon exposure to temperatures at or below 1800° F., aluminum casting cleanup could be greatly improved.

Accordingly, it would be desirable to provide an improved method of removing an investment casting shell surrounding a metallic part.

Batllo U.S. patent application Ser. No. 10/337,799 addresses this issue by adding a salt of alkali or alkaline earth metal to at least one of the layers of an investment casting shell. The addition of a salt of alkali or alkaline earth metal effectively improves the removal of the investment casting shell surrounding a metallic part by reducing the shell strength, particularly after firing.

Such addition of alkaline earth metal salt, such as calcium carbonate added to the "green" investment casting shell, can provide a weakening effect that results in a two to threefold increase in erosion speed of the fired shell that surrounds the solidified metal casting, as measured by blasting tests such as sandblasting.

SUMMARY OF THE INVENTION

By this invention, a further improvement of the method of removal of an investment casting shell surrounding a metallic article is provided. The improvement is effective for investment casting shells of the type disclosed in the Batllo U.S. patent application cited above, the shells being made by depositing respective layers of refractory slurry and stucco onto a pattern, and containing, after firing, an amount of an alkali metal oxide or alkaline earth metal oxide sufficient to reduce the strength of the shell. By this invention, the shell is fired in generally conventional manner, typically above 1100° F., and ferrous or nonferrous, molten metal is poured into the shell to form the metallic article therein. Following this, the shell is hydrated, whereby the strength of the shell is further reduced, to facilitate its removal from the metallic part by breakaway. The hydration step takes place generally after the molten metal has solidified in the shell, so that the shell is ready to be removed.

Typically, an alkaline earth metal oxide may be used as the shell-weakening ingredient, particularly calcium oxide, which may be initially added to the shell before firing in the form of a salt such as a calcium salt, calcium carbonate, as an ingredient in the stucco, for example, forming calcium oxide during firing. In another embodiment, a magnesium salt may be utilized. The salt of alkaline metal or alkaline earth metal is added to at least one layer of the investment casting shell to provide the desired weakening effect, which weakening effect is typically magnified upon firing of the shell, and then further magnified by the hydration step, so that the shell is more easily removed from the casting.

The salts of alkali or alkaline earth metals which may be used in the practice of the invention to form the investment casting shell include, among others, calcium carbonate, calcium sulfate, calcium magnesium carbonate, magnesium carbonate, magnesium sulfate, strontium carbonate, sodium carbonate, potassium acetate, and mixtures thereof. A preferred salt of alkali or alkaline earth metal for use in improving the removal of an investment casting shell from a metallic part is calcium carbonate. Oxides are then generally formed on firing.

The salt of alkali or alkaline earth metal can be added to at least one of the layers of the investment casting shell. In a preferred embodiment, the salt of alkali metal or alkaline earth metal is added to at least one layer of the refractory stucco, which is typically added as a dry powder sticking to a slurry layer previously placed on the shell. However, in the practice of the present invention, the salt of alkali or alkaline earth metal may alternatively be added to at least one layer of the refractory slurry, or to at least one layer of both the refractory slurry and the refractory stucco.

The hydration step may be performed after the metal casting, contained in the shell after pouring, has solidified. The hydration may be performed by a water spray, dipping of the shell in water, or a similar process. Effective hydration can also take place by exposure of the metal-filled shell to air, typically of at least about 50% relative humidity at elevated temperatures, when acceleration of the process is desired. Such humid air can greatly accelerate hydration, so it is generally preferred for the hydration step using humid air to take place at an elevated shell temperature of at least about 100° C. and at least 50% relative humidity.

As stated above, alkali metal salts and alkaline earth metal salts may be added as ingredients to the slurry and stucco formulations used to make the various layers of the shell, with the metal salts being included in at least one such layer and optionally any number or all of the layers. One suitable alkaline earth metal salt is the carbonate salt, particularly calcium carbonate. Then, upon firing, the alkali metal salt or alkaline earth metal salt which is used is converted, typically for the most part, to alkali metal oxide or alkaline earth metal oxide, which is formed in situ in the shell by heat decomposition. Alternatively, the alkali metal oxide or alkaline earth metal oxide itself may be directly added during the shell making process.

Typically, an amount of about 1-40 weight percent of the alkali metal oxide or alkaline earth metal oxide may be present, based on the weight of the shell.

The salt of alkali metal or alkaline earth metal is used at a concentration that will effectively improve the removal of an investment casting shell surrounding a metallic part by weakening it. In some embodiments, the amount of salt of alkali or alkaline earth metal is from about 5 to about 40%, with about 8 to about 25% being typically in some embodiments, based on the weight of the shell.

Typically, at least one layer of the shell contains about 25 to 70 or 75 weight percent of the alkali metal oxide or alkaline earth metal oxide, based on the individual layer material.

Furthermore, the alkali metal oxide or alkaline earth metal oxide may, in some preferred embodiments, be present in at least one layer of the stucco material, and may have a first average grain size. The stucco also contains a finely divided refractory material such as fused silica, quartz, alumina, aluminosilicate, zircon, zirconia or another known material used in this manner. The finely divided refractory material preferably has a second grain size that is typically no more than 50% greater or less, than the first average grain size.

The effect of weakening on hydration can be magnified by this manner. The particles of alkali metal oxide or alkaline earth metal oxide will tend to swell upon hydration, and increased mechanical deformation can take place in the fired, hydrated investment casting shell which can cause the generation of cracks and the further reduction of strength in the shell.

For example, the first average grain size may be 30-50 mesh.

Also, as previously discussed, the shells that are used to form aluminum, copper, and magnesium castings, among others, typically have melting and pouring temperatures that are insufficient to promote cristobalite formation. Thus, the shells remain unduly strong after firing, and are difficult to remove from the castings.

Further advantages achieved in accordance with this invention, when the shell is fired at a temperature of less than about 1800° F., as is typically the case relative to the nonferrous metals mentioned above. The shell can be weakened through hydration, even though Cristobalite phase transition does not take place.

The adding of a salt of alkali or alkaline earth metal to at least one layer of an investment casting shell effectively improves the removal of the shell surrounding the metallic part by weakening the shell, after it is conventionally fired. By this invention, further improvement is provided by hydration of the shell after the molten metal casting has hardened.

DESCRIPTION OF THE SPECIFIC EMBODIMENTS

Figure 1:
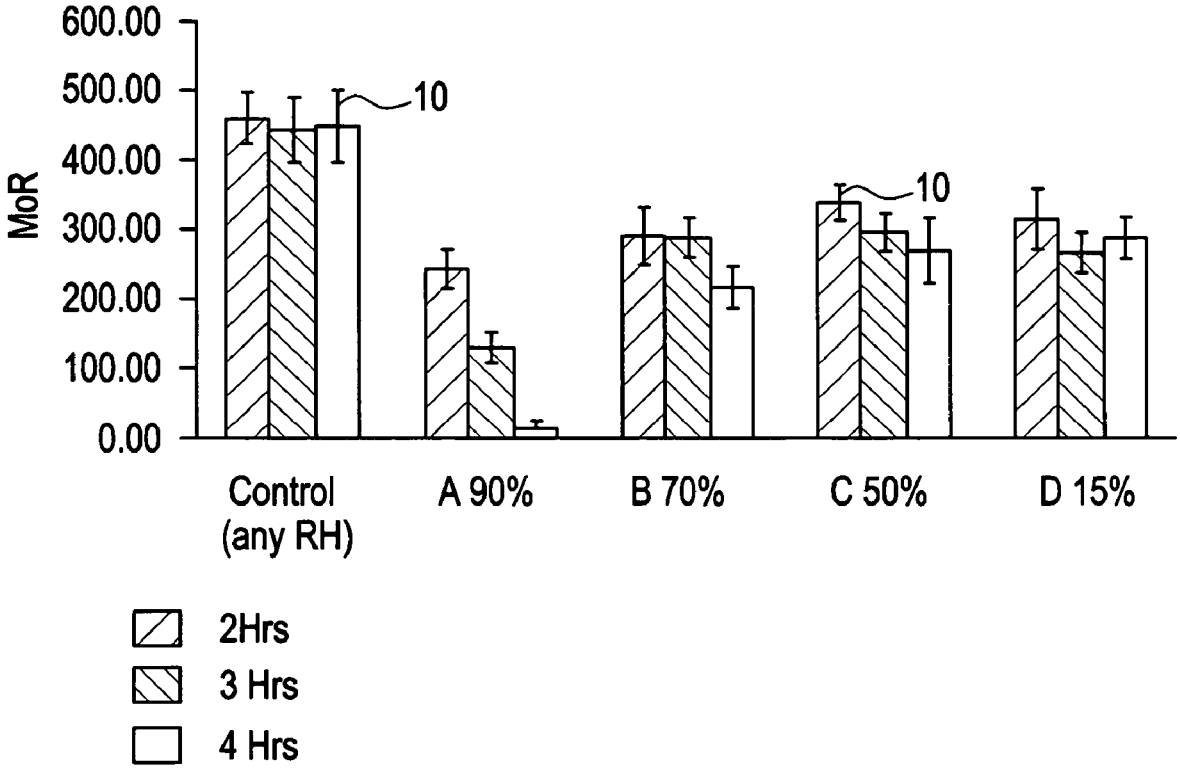
FIG. 1 is a graph showing the effect of hydration by humid air on the strength of shell wall material.

The following examples are intended to be illustrative of the present invention, and to teach one of ordinary skill how to make and use the invention. These examples are not intended to limit the invention or its protection in any way.

EXAMPLE 1

To determine the effect of hydration on a fired wall of material used to make investment casting shells, rectangular wax bars were dipped into a priming slurry of commercial type comprising: 37 gallons of a pre-blend binder (95% Nalco 6010 finely divided silica with 5% of Nalco 6300 organic polymer); 300 ml of Nalco 8815 wetting agent; 200 ml of an anti-foam agent; 500 lbs. of 200 mesh fused silica flour; and 500 lbs. of 200 mesh zircon flour). The wax bar made of this material was dipped into the slurry along most of its length, the bar being of dimensions ¼ by 1 by 8 inches.

The wax bar was withdrawn, sprinkled with a conventional zircon stucco material, and allowed to dry.

The dried bar was then dipped into a second slurry comprising 72.25 gallons (727 lbs. of liquid formulation) of Nalco 1130 colloidal silica with biocide and fungicides or Nalco 6011; 10.5 gallons (87.3 lbs.) of a binding polymer conventionally used with Gray Matter™ silica formulation; 17.4 gallons of deionized water; 38 bags (2090 lbs.) of the commercial Gray Matter™ silica formulation; and 2.5 liters of anti-foam agent 2305, to provide a slurry having a viscosity of 11-13 seconds as measured on a No. 5 signature Zahn cup.

Following this, a finely divided stucco material (30×50 Mesh) of this invention, comprising about 70 weight percent of silica and 30 weight percent of calcium carbonate, was sprinkled on the bar which was coated with the second slurry material, and allowed to dry.

This step of application of the second slurry, and sprinkling with the silica-calcium carbonate stucco material, was repeated three more times, with drying in between. Following this a final application of the second slurry was provided by dipping of the bar, followed by drying.

Then, the edges of each bar were removed with a belt sander, providing two, spaced ceramic shell wall plates, separated by the wax bar. The two remaining plates were separated from the wax, and fired at 1000° C. for two hours. The shell wall plates were tested for modulus of rupture with a three point loading apparatus, applying pressure in one direction at the two ends of the ceramic face bar, and at the other direction in the middle of the ceramic face bar, to obtain a modulus of rupture on breakage. Such wall plates were tested with and without hydration, and also tested against similar shell wall plates in which the stucco was made primarily of silica, and was free of calcium carbonate.

Upon exposure to water spray at a wall plate bar temperature of 25° C., the plates that contained calcium formed cracks within one hour, while the identical control shell wall plates not exposed to water spray did not crack. However, merely by standing in the atmosphere, the control shell wall plates that contained calcium formed cracks within four hours.

When a water spray was applied to the shell wall plates containing calcium while the plates were at a temperature of about 100° C., cracks formed within four minutes, while the similarly heated control shell wall plates having no calcium did not exhibit any cracks under those conditions for a period of more than four hours.

When a water spray was applied to the shell wall plates containing calcium when the plates were the temperature of 200° C., cracks formed in 1½ minutes, while the control shell wall plates, so heated, and free of calcium, did not exhibit cracks over a period in excess of four hours.

From this, it can be seen that shell wall plates that contain calcium carbonate are subject to weakening by hydration, particularly when the shell wall plate is hydrated at an elevated temperature. These shell wall plates are similar to portions of an actual shell wall, and in the long term experience of the industry, are good indicators of the behavior of actual investment casting shells.

EXAMPLE 2

Sets of investment casting shells were prepared and used to cast articles of aluminum using a conventional silica and zircon slurry formulation. The investment casting shells used in this invention contained 30 weight percent calcium carbonate in a 30×50 Mesh stucco formulation (the remainder being substantially silica). The control investment castings shells were made identically to the casting shells containing calcium, except that the control shells replaced the calcium carbonate with more silica in the stucco.

The aluminum investment castings were made with six slurry coatings, interspersed with five additions of stucco, in a manner generally similar to that of Example 1. After firing of the shells and investment casting, two shells containing aluminum castings with different geometries were subjected to water blast to remove the castings. They were also sprayed with water after pouring of the mold, and prior to the water blast, while the temperature remained elevated, to accelerate the hydration reaction.

The time involved to break away the shell from the first aluminum parts, using a water blast system, was about 510 seconds for the shells that contained calcium, and about 700 seconds for the control shells that were free of calcium.

The time of water blasting required to fully remove the shells from the second aluminum parts by means of a water blast system was about 180 seconds for the shells that contained calcium, and about 260 seconds for the shells that were free of calcium.

EXAMPLE 3

Bars for testing modulus of rupture were made in a manner similar to claim 1 by repeatedly dipping a wax bar into a slurry, the first five of such dips being followed by application before drying of the previously described stucco mixture comprising 70 weight percent of finely divided fused silica and 30 weight percent of calcium carbonate, the mixture being 30×50 Mesh. The slurry formulation for each of the six dips comprised a mixture of 72 weight percent of Nalco Gray Matter™ silica slurry material; 0.16% Nalco 2305 antifoam agent; 0.05 weight percent Nalco 8815 wetting agent; and 27.79 weight percent of binder, which, in turn, consisted of 70.2 weight percent Nalco 1130 colloidal silica; 20.8 weight percent of deionized water; and 9.0 weight percent of Nalco 6300 binding polymer. The resulting material was controlled to a viscosity of about 18 seconds as indicated on a Guardco/ISO Mini Dip viscosity cup with a 6 mm orifice, by the addition of Nalco Gray Matter™ material as necessary. Six sequential dips were provided, with the first five dips receiving a sprinkling of the above-described stucco material and the sixth dip comprising a sealing dip. The bars were allowed to dry between dips.

Then, a pair of faces of the bar were separated from the wax as described in Example 1, to provide a pair of shell wall plates. The shell wall plates were fired for 102 minutes at 1832° F. The shell wall plates were then exposed as they cooled to varying humidity rates for 2-4 hours, and each was then tested for modulus of rupture. This was compared to control shell wall plates which were made in similar manner, but the calcium present in every layer was replaced with more finely divided silica.

The results are as indicated in FIG. 1. The letters A through D refer to the shell wall plates that contain calcium, while "control (any RH)" refers to control bars in which the calcium carbonate was replaced with finely divided silica, and for which the humidity had no effect on the strength. The percentages following each of letters A-D refer to the relative humidity of the air in which the cooling bars resided for 2-4 hours, as identified by the graph bars of varying shades, which shades indicate the time of exposure to the humid air.

The various vertical lines 10 comprise error bars for the data.

From these data, it can be seen that the respective shell wall plates that contain calcium are significantly sensitive to humid air, with the sensitivity tending to grow with the relative humidity of the air to which they are exposed. For example, an exposure of 4 hours to air of 90% relative humidity causes the shell wall plate material almost disintegrate completely.

The above has been offered for illustrative purposes only, and is not intended to limit the scope of the invention, which is as defined in the claims below:

What is claimed is:

1. A method of improving the removal of an investment casting shell surrounding a metallic article, said shell being made from the deposit of layers of refractory slurry and stucco onto a pattern, and containing, after firing, an amount of an alkali metal oxide or an alkaline earth metal oxide sufficient to reduce the strength of the shell, which comprises the steps of:

firing the shell, pouring the molten, metallic part into the shell, and then hydrating the shell, whereby the strength of the shell is further reduced to facilitate its removal from the metallic part, wherein said alkali metal oxide or alkaline earth metal oxide has a first average grain size, and is present in at least one layer of said stucco, said stucco also containing a finely divided refractory material having a second average grain size that is no more than 50% greater or less than the first avenge grain size.

2. The method of claim 1 in which said refractory material comprises fused silica.

3. The method of claim 1 in which said refractory material comprises aluminosilicate.

4. The method of claim 1 in which said refractory material comprises zircon.

5. The method of claim 1 in which said first average grain size is 30-50 mesh.

6. A method of improving the removal of an investment casting shell surrounding a metallic article, said shell being made from the deposit of layers of refractory slurry and stucco onto a pattern, and containing, after firing, an amount of calcium oxide or magnesium oxide sufficient to reduce the strength of the shell, which comprises the steps of:

firing the shell at a temperature above about 1100° F. and less than about 1800° F., pouring the molten, metallic article into the shell, and then hydrating the shell, whereby the strength of the shell is further reduced to facilitate its removal from the metallic part, wherein said magnesium or calcium oxide has a first average grain size, and is present in at least one layer of said stucco, said stucco also containing a finely divided refractory material having a second average grain size that is no more than about 50% greater or less than the first average grain size.

7. The method of claim 6 in which said refractory material is fused silica and the first average grain size is 30-50 mesh.

8. A method of improving the removal of an investment casting shell surrounding a metallic part, said shell being made from the deposit of layers of refractory slurry and stucco onto a pattern, and containing, after firing, an amount of calcium oxide sufficient to reduce the strength of the shell, which comprises the steps of:

firing the shell, pouring the molten metallic part into the shell, and then hydrating the shell, said calcium oxide having a first average grain size and being present in at least one layer of said stucco, said stucco also containing a finely divided refractory material having a second average grain size that is no more than about 50% greater or less than the first average grain size, whereby the strength of the shell is further reduced to facilitate its removal from the metallic part, and then hydrating the shell, whereby the strength of the shell is further reduced to facilitate its removal from the metallic part.

9. The method of claim 8 in which said refractory material comprises fused silica and the first average grain size is 30-50 mesh.

10. The method of claim 8 in which the shell is fired at a temperature above about 1100° F.

* * * * *